US005751659A

United States Patent [19]

Giwer

[11] Patent Number: 5,751,659

[45] Date of Patent: May 12, 1998

[54] CERAMIC MASS LOADED LONGITUDINAL VIBRATOR

[76] Inventor: Matthias M. Giwer, 1201 S. Scott St., Apt. 630, Arlington, Va. 22204

[21] Appl. No.: 862,647

[22] Filed: Sep. 29, 1969

[51] Int. Cl.[6] ..... H04R 17/00

[52] U.S. Cl. ..... 367/158; 367/162; 367/165; 367/167; 310/337

[58] Field of Search ..... 340/10; 310/337; 367/157, 158, 159, 162, 165, 167, 172, 173, 176

[56] References Cited

U.S. PATENT DOCUMENTS

| | | | |
|---|---|---|---|
| 2,977,572 | 3/1961 | Pope | 367/165 |
| 3,337,843 | 8/1967 | Kendig et al. | 367/158 |
| 3,460,061 | 8/1969 | Massa | 340/10 X |
| 3,474,403 | 10/1969 | Massa et al. | 340/10 |

*Primary Examiner*—Harold J. Tudor

[57] ABSTRACT

A sonar transducer displaying improved reliability and operating characteristics by employing multiple ceramic stacks, novel support structure and an improved gaseous environment.

7 Claims, 1 Drawing Sheet

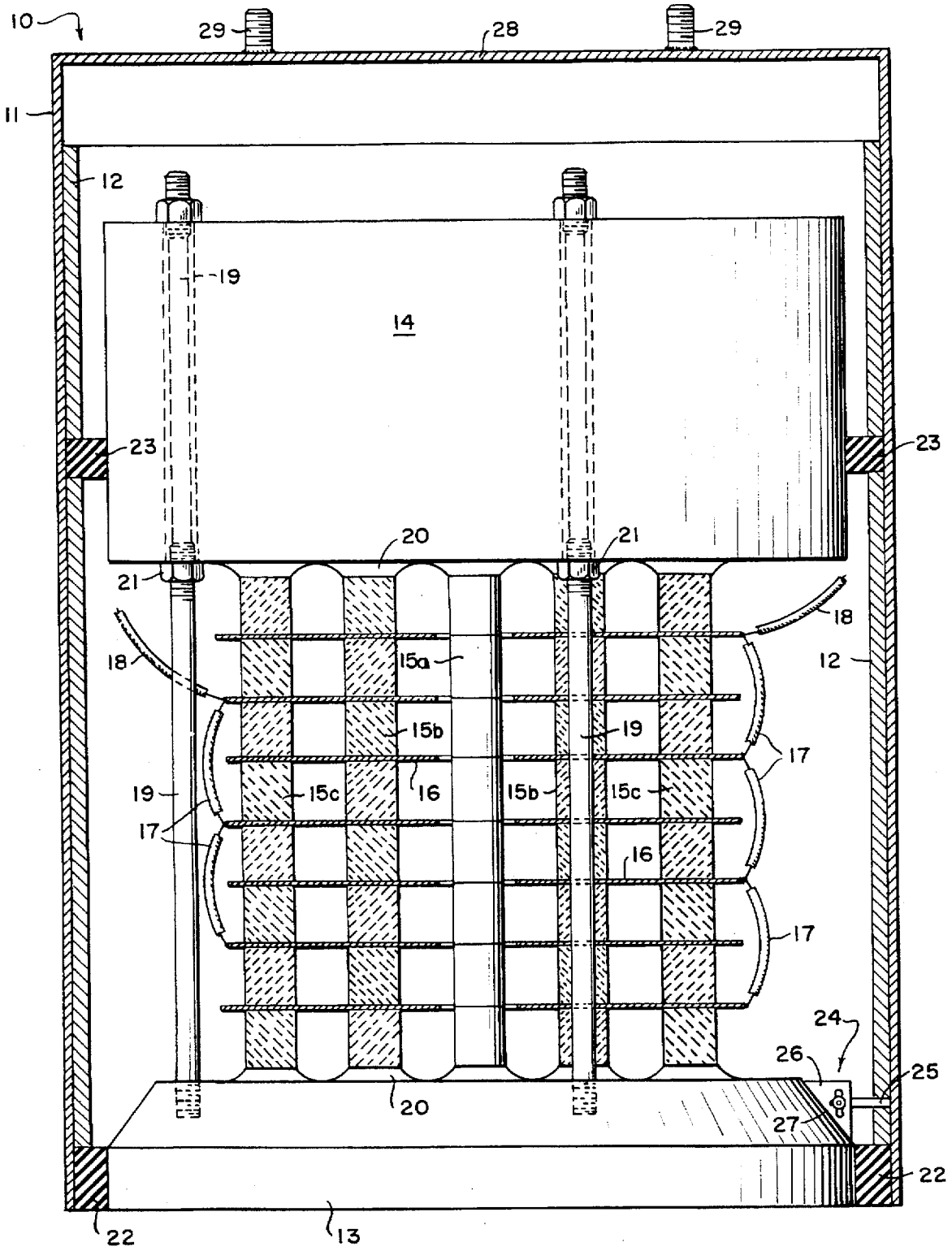
10
29
28
29
11
12
19
14
23
23
20
21
21
18
18
12
15a
15b
19
17
19
15c
16
15b
15c
17
16
17
24
26
25
20
27
22
22
13

CERAMIC MASS LOADED LONGITUDINAL VIBRATOR

The invention described herein may be manufactured and used by or for the Government of the United States of America for governmental purposes without the payment of any royalties thereon or therefor.

BACKGROUND OF THE INVENTION

The present invention relates to acoustic transducers and more particularly to a new and improved ceramic sonar transducer.

Known ceramic transducers for use in sonar applications of the type related to this invention, consist of a single ceramic stack which is composed of ceramic or metal and ceramic rings. Such prior art transducers have had poor characteristics relating to shock resistance, voltage breakdown, side and back radiation, forward radiation, efficiency at substantial depths and dynamic range. They are further limited in output power and output linearity, and display great variation of characteristics with depth. When a plurality such transducers are placed in an array, there is objectionable interaction between transducers due to the side and back radiation of the individual transducers.

When a single stack transducer is employed to achieve a given source level, it will have a relatively higher power density and a lower compliance than is possible with the present invention. There are, therefore, outstanding requirements for sonar transducers displaying good shock resistance, high voltage breakdown, low side and back radiation, high forward radiation, high efficiency at substantial depths, good output linearity throughout substantial depth variations and good dynamic range. Such requirements have proved difficult to achieve in the past, however, the present invention does disclose an apparatus capable of meeting these requirements.

Accordingly, it is an object of the present invention to provide a new and improved sonar transducer.

Another object is to provide a sonar transducer with improved shock resistance characteristics.

A further object is the provision of a sonar transducer with improved high voltage breakdown characteristics.

Still another object is to provide a sonar transducer with low side and back radiation.

A still further object is to provide a sonar transducer with high relative forward radiation and sensitivity.

Another object is to provide a high efficiency sonar transducer which maintains such at substantial depths.

Still another object is to provide a sonar transducer with an improved dynamic range characteristic.

A further object is to provide an improved housing for a sonar transducer.

A still further object is to provide a new gaseous environment for a sonar transducer.

Other objects and advantages, as well as the exact nature of the invention, will be readily apparent to those skilled in the art from the consideration of the following disclosure of the invention.

SUMMARY OF THE INVENTION

The present invention accomplishes the above-cited objects by providing a ceramic type sonar transducer which is suitable for operation in a deep ocean environment for both active and passive applications.

More specifically, there is provided a sonar transducer which deviates from the prior art design practice in that there are two stacks of ceramic or ceramic and metal rings rather than one. With two stacks instead of one, any particular power density requirement can be more easily met by providing the greater volume of the two stacks while also increasing compliance which is proportional to the cross sectional area of the stack divided by its length. Conversely, a particular compliance requirement specified for a one stack transducer can be achieved with an increase in power at the same time.

It should be understood that in terms of the subject matter of the invention, high compliance relates to lack of resistance to bending or lack of rigidity of the ceramic material. While a high degree of compliance is desirable with respect to achieving good signal sensitivity, the amount of compliance must be kept reasonable because an extreme lack of rigidity will allow cracking of the ceramic material.

The two stack configuration will give more even support to the head and tail masses which allows the masses to act in a more perfect and predictable manner. Concurrent with supplying more uniform support is the provision of greater shock resistance because the amount of flexing and bending of the stocks is significantly reduced. The two stack configurations also allow operation at power levels formerly associated with disk type transducers while allowing the greater shock resistance of rings.

To increase the voltage breakdown characteristic of the device, a novel gaseous mixture of argon and methane forms the environment for the ceramic or ceramic and metal rings which are enclosed by a gas tight housing.

BRIEF DESCRIPTION OF THE DRAWING

The sole FIGURE is a side view of a sonar transducer illustrating a preferred embodiment of the invention.

DESCRIPTION OF THE PREFERRED EMBODIMENT

Referring now to the FIGURE, there is shown a side view of a sonar transducer 10 which illustrates a preferred embodiment of the invention.

Transducer 10 generally consists of a can 11 which is lined throughout most of its interior with a pressure release material 12, a head mass 13 and tail mass 14, and between the two masses, multiple stacks of ceramic or ceramic and metal transducer material **15*a*, 15*b*, 15*c*. The can 11** forms an integral part of a gas tight housing containing a gas.

Prior art transducers are known to have a single stack of ceramic or ceramic and metal rings while, as shown, the present invention has three stacks of ceramic or ceramic and metal material. The center stack **15*a* is cylindrically shaped and is provided for sensing motional information about the transducer for a feedback control system. Two concentric stacks of rings 15*b*, 15*c*, constituting the major transducer elements are placed about center stack 15*a*. The three stacks 15*a*, 15*b*, 15*c* are physically separated by plates or disks 16. The rings are silvered on their plate interface surfaces (not shown) in order to make good electrical connections with the plates. All the plates 16 have holes in the center so the center stack 15*a*** is isolated from the ring and plate assembly.

Jumper wires 17 short every other plate 16 on alternate sides of the plates which, from an electrical standpoint, places the rings **15*b*, 15*c* in parallel. Lead wires 18, carrying detected signals as well as leads from stack 15*a*, may be connected to a transformer, autoformer, or inductor and are made to extend outside of can 11 (not shown) in any conventional water and gas tight fashion. To protect the rings from destructive voltage breakdown the plates have flanged edges which extend beyond the rings 15*b* and 15*c***. This insures that if a voltage breakdown between the plates does occur, it will occur at the edges of the plates due to the reduced gap rather than through the ceramic rings.

The ring and plate assembly is held together by a compressive force which results when the multiple stress rods 19 are tightened. This results in a clamping action which pins the ring and plate assembly between the head mass 13 and the tail mass 14. Before tightening, the assembly is oriented to be accurately located on the raised fluted mountings or fillets 20 which are machined out of the head and tail masses. The mountings 20 appear to increase reliability because they provide more even support to the head and tail masses 13, 14, thus preventing, among other things, flopping of the components and also decreasing some of the internal stresses in the projector.

Ordinarily, the prior art employed a single stress rod through the center of the stack. Such a configuration gave little resistance to any shock waves which strike the transducer off the longitudinal axis. Under such circumstances, a shock will induce flexing and bending of the ceramic transducer material, often to the point of destruction. The invention, as shown, employs three, four or more multiple stress rods 19 around the outside periphery of the rings **15*c*** which help prevent bending and avoid damage to the ceramic except in severe cases. An additional benefit of the multiple stress rod embodiment is that such a design will allow the application of greater prestressing levels which is desirable for increasing transducer efficiency.

The head mass 13 is generally cylindrical and should be designed to be light, stiff and strong. Suitable metals include titanium and aluminum. Tail mass 14 is cylindrical and requires a metal which is more dense than the metal used for the head mass, such as lead. If the metals used for the head and tail masses are corrosive, a rubber type boot could be employed as a covering.

Elements 21 are nuts which serve as flanges for shock isolation. Through their use, the portion of the stress rods 19 which pass through the tail mass is effectively isolated from the remainder of the rods. This helps to reduce the effect of shocks by requiring that a shorter length of rod absorb the shock and shortens the amount of relative motion between the head and tail masses thus lowering the stress on the ceramic materials.

The unit, as described thus far, is mounted within can 11 by means of two mounting washers and one or more slotted fasteners. One of the washers, rubber washer 22, surrounds the head mass 13 while the other mount, washer 23, made of rubber, steel, etc., surrounds the tail mass 14. One or more slotted fasteners 24 comprising a pin assembly 25 extending inward from can 11 and a slotted tab 26 mounted on the internal chamfered edge 27. Since the tabs 26 are slotted in the longitudinal direction, longitudinal oscillation is allowed but radial, flexural or bending motion of the head mass is restricted.

The steel can 11, washer 22 and the externally exposed portion of head mass 13 form a liquid and gas tight housing which is filled with a gaseous mixture which is 90% argon and 10% methane. The prior art gases included air, carbon dioxide and nitrogen, all of which were susceptible to voltage breakdown, and, when such occurred, allowed substantial damage to the ceramic components and the electrodes. Moreover, the long term aging effects of these gases are not known. The gaseous mixture employed in this invention, however, has good voltage breakdown resistance and when such does occur, little damage results in the parts over which the breakdown takes place. Additionally, this mixture is known to have good long term stability.

A pressure release material 12, which is effective in damping vibrations, is mounted around the inner cylindrical surface of can 11 in order to prevent sound from the inside of can 11 from radiating outside. When mounted as shown, the static pressure, which varies with depth, will have little effect on the efficiency of the material which is usually corprene or onion skin paper. Such construction allows the material to function properly at greater depths than that allowed by the prior art.

The overall length of the projector, i.e. the distance from the exposed edge of the head mass to the edge of the tail mass most remote from the ceramic components, is about one foot for the more common operating frequencies in the area of a few kilocycles. The one wavelength of the projector will allow greater compliance, greater power for a given power density and greater dynamic range and linearity because such a design allows a longer stack to be used. It also allows greater prestressing than shorter transducers.

Mounting washer 23 is placed at a quarter-wave point from the rear end of the transducer, which, because of the weight of the tail mass 14, is also the center of mass of the transducer. The quarter-wave point is selected because it is a mode constituting a minimum stress point. This allows the washer to act as a shock absorber which can decouple the can 11 from the acoustic signal contained in the transducer assembly. Such a design also avoids having the can 11 move with the tail mass 14 which, in turn, avoids loss of signal sensitivity and energy as well as avoiding destruction of the mount when subjected to substantial shocks.

The half-wave point from the exposed surface of the head mass 13, one of the maximum stress points, should be somewhere towards the center of the ceramic stacks in order to achieve maximum signal sensitivity. The distance from the tail mass 14 to the rear 28 of the can 11 should be one-quarter of a wavelength of the sound wave in the gaseous mixture employed. This will allow the maximum amount of reflection from the rear of the case and allows some of the reflected energy to be regained by the transducer. The reflected energy is not transmitted through the back of the case and thus does not contribute to the interaction problems of back radiation.

Two screws 29 are provided on the outside surface of rear end 28 in order to enable fastening of the can to a mount. Of course, any suitable conventional fastening means could be provided.

What has been disclosed is a multi-stack sonar transducer with improved characteristics relating to shock resistance, voltage breakdown, low side and back radiation, high forward radiation and sensitivity, efficiency and dynamic range. It should be understood, of course, that the foregoing disclosure relates only to a preferred embodiment of the invention and that numerous modifications may be made therein.

What is claimed is:

1. In a sonar transducer having:

a gas tight housing; and an acoustic sensor assembly within said housing;

the combination therewith of gaseous mixture within said housing substantially consisting of 90% argon and 10% methane.

2. An acoustic sensing device comprising:

a housing;

a head mass at one end of said housing;

a tail mass located within said housing at a position remote from said head mass;

at least two stacks of sensing elements, said stacks being located between said head mass and said tail mass;

said at least two stacks of sensing elements being two substantially concentric stacks of ceramic rings; and an additional stack of ceramic material located within an inner concentric ring.

3. An acoustic sensing device comprising:

a housing;

a head mass at one end of said housing;

a tail mass located within said housing at a position remote from said head mass;

at least two stacks of sensing elements, said stacks being located between said head mass and said tail mass; and said housing being attached to said head mass bymmeans of a slotted fastener.

4. An acoustic sensing device comprising:

a housing;

a head mass at one end of said housing;

a tail mass located within said housing at a position remote from said head mass;

at least two stacks of sensing elements, said stacks being located between said head mass and said tail mass; and pressure release material placed radially about said sensing elements within said housing

5. An acoustic sensing device comprising:

a housing;

a head mass at one end of said housing;

a tail mass located within said housing at a position remote from said head mass;

at least two stacks of sensing elements, said stacks being located between said head mass and said tail mass; and multiples stress rods placed radially about the said sensing elements and attached to said head and said tail masses.

6. An acoustic sensing device comprising:

a housing;

a head mass at one end of said housing;

a tail mass located within said housing at a position remote from said head mass;

at least two ceramic of sensing elements, said stacks being located between said head mass and said tail mass; and the edge of said head mass most remote from said tail mass being separated from a point within said ceramic stacks by a distance of one-half wave length, a mount attaching said housing to said tail mass located an additional one-quarter wave length from said point within said ceramic stacks, the edge of said tail mass most remote from said head mass being located an additional one-quarter wave length from said mount and said housing having a reflecting surface located an additional one-quarter wave length from said tail mass remote edge.

7. An acoustic sensing device comprising;

a housing;

a head mass at one end of said housing;

a tail mass located within said housing at a position remote from said head mass;

at least two stacks of sensing elements, said stacks being located between said head mass and said tail mass; and said housing being gas tight and containing a gaseous mixture of substantially 90% argon and 10% methane.

* * * * *